United States Patent [19]

Grunewald

[11] 4,285,219

[45] Aug. 25, 1981

[54] APPARATUS FOR TREATMENT OF LAUNDRY

[75] Inventor: Heinz L. Grunewald, Bremen, Fed. Rep. of Germany

[73] Assignee: Engelhardt & Föster, Bremen, Fed. Rep. of Germany

[21] Appl. No.: 3,397

[22] Filed: Jan. 12, 1979

[51] Int. Cl.[3] ..... D06F 29/02

[52] U.S. Cl. ..... 68/19.2; 34/58; 34/236; 68/210

[58] Field of Search ..... 68/19.2, 210; 34/58, 34/236

[56] References Cited

FOREIGN PATENT DOCUMENTS 467594 6/1937 United Kingdom ..... 68/210

*Primary Examiner*—Philip R. Coe

*Attorney, Agent, or Firm*—George C. Atwell

[57] ABSTRACT

A method is provided, along with apparatus for practice of the method, wherein laundry, such as linen or the like, is treated, following a washing operation applied thereto, by applying centrifugal force to extract rinsing liquid from a saturated laundry batch and then applying to the exterior of the laundry batch a pressurized fluid flow as a further treatment step, which is withdrawn from the laundry work batch from a point generally within the batch whereby rinsing liquid is withdrawn in a direction countercurrent to the preceding centrifugal extraction step. A suction may be applied at a point within the batch to either establish or enhance the liquid extraction operation.

The apparatus of the invention includes a perforated spin-drying drum within a housing such that a circumjacent space is defined between the drum and the housing, and a remotely located blower in conduit communication with the housing generates a pressurized flow to the circumjacent space. The same blower may also be utilized to create a suction or negative pressure area within the drum, and the conduit from the blower, which is utilized to establish the suction in the drum, may also serve as a means of transporting laundry from the drum to other stations of the laundry treating system for subsequent treating steps.

9 Claims, 2 Drawing Figures

APPARATUS FOR TREATMENT OF LAUNDRY

BACKGROUND OF THE INVENTION

This invention relates generally to equipment for treating laundry which uses a rotatable spin-drying perforated drum disposed within a housing. The invention more particularly pertains to equipment utilized for the extraction, or more accurately, the pre-extraction, of water by centrifugal force, from previously washed laundry which is placed in condition for such treatment by drying or wringing steps which precede the extraction action.

Throughout the specification "treatment" of laundry broadly means the steps involved in taking soiled laundry through washing, extraction and drying steps to render it in an acceptably clean state and may include preparation of the laundry for a liquid extraction operation, completion of the liquid extraction operation and further activity following the extraction operation. Reference to "laundry" in this specification primarily means linen in the form of undergarments, bed linen, table linen, etc., and other articles suitable for normal laundering but may also include other items such as cleaning cloths, skins or the like.

In a conventional laundry treating system wherein laundry is subjected to washing in a washing unit and then transported to a different unit for further treatment, the laundry is typically saturated with rinse water just prior to its discharge from the washing unit and is, therefore, subjected to pre-extraction to reduce the saturation before further liquid removal in a dryer unit and/or subsequent wringing. The preceding operation, which herein is referred to as "water extraction," may be carried out in spin-drying units which involve the application of centrifugal force, or may be accomplished by the use of mangles or wringers which utilize pressure for water extraction. Although a centrifuge involves a higher capital investment, it is acknowledged in the art as superior to wringers for water extraction purposes, extracting water not only more rapidly but to a significantly higher degree. For this reason it is generally found in a commercial laundry that laundering in a washing machine is usually followed by a treatment step in a spin-dryer and this is followed by transporting the laundry either to a dryer or to a wringer and may also involve the interposition of a tumbler to loosen the items in the laundry batch.

In most installations spin dryers are units with a vertical axis which are charged and emptied in various ways and the laundry is generally transported between different units of a laundry system or plant by means of conveyor belts or similar transporting means. A main problem of such systems is the charging of the spin-drying unit because wet clothing has characteristics or properties which resist the application of conventional conveying technology. A further problem of such systems is the uniform distribution of a batch of laundry in the spin-dryer unit. Non-uniform distribution results in load imbalance and the consequent disadvantages associated therewith, particularly bearing and shaft stress, noise of operation and a reduced useful life of the unit. Unloading of the spin-drying unit after the water extraction operation is an even greater problem. The laundry, which has been subjected to centrifugal force, tends to bind densely against the inside of the spin-drying drum and stick against the drum inside surface. The effect is further intensified because the preceding washing and transfer of the laundry to the spin-drying unit, and the subsequent application thereto of the spin-drying operation, tends to thoroughly mix, tangle and tightly compress the laundry when it is compacted outwardly by the centrifugal force. Consequently, even when manual release of the laundry from the spin-drying drum, after water extraction, is accomplished, the laundry is nevertheless so compressed that it requires tumbling in a separate unit to loosen the compressed mass into separate clothing items.

Still another common problem of known laundry systems is the considerable expenditure associated with the equipment and labor involved in accomplishing the transfer of laundry, after washing or water extraction, from one station to another, which frequently includes the additional disadvantage of laundry items being mislocated to dangle from conveyor belts or similar devices.

SUMMARY OF THE INVENTION

This invention comprehends improved apparatus for use in laundering which will obviate or greatly reduce many problems and disadvantages now associated with commercial laundry facilities, including the disadvantages herein related.

One primary objection of this invention is the reduction of presently required investment and labor in the practice of laundering operations. A second and specific objective of the present invention is the provision of means by which laundry, after liquid has been extracted therefrom by centrifugal force, can be readily released and loosened whereby no separate tumbling operation is required. Still another objective is to provide apparatus which enables a spin-drying unit to be more easily loaded and unloaded.

An additional and important objective of the present invention, associated directly with the invention's apparatus, relates to the provision of means for easily charging and emptying the spin-drying unit and uniformly distributing laundry in the spin-drying drum whereby any active bacteria remaining in the laundry batch after washing will be subsequently killed.

Practice of the method of the present invention involves subjecting the wash laundry to a suction force applied to the inside of the laundry batch and/or to positive pressure exerted on the outside of the laundry batch, all of this following the water extraction operation. Moreover, loosening of the entangled items in the laundry batch is enhanced by subjecting the laundry, at a point within the batch, to a greater negative pressure than the positive pressure applied around the outside of the batch.

It is a feature of the present invention that washed batches of laundry are uniformly distributed by means of water before the occurrence of the water extraction operation, the final rinse water preferably being used for this purpose. This enables a more uniform water extraction due to the substantially uniform distribution of the individual articles of the laundry batch before extraction of the water therefrom.

In the apparatus of the invention, the space between the housing and the perforated drum casing of a spin-drying unit is in fluid flow connection with a pressurized fluid source and includes means therewith to selectively interrupt the flow. In addition, a means is provided for subjecting the interior of the spin-drying drum to suction, which may be applied separately or in combination with the fluid flow applied to the annular space circumjacent the perforated drum.

The pressurized fluid source is preferably a compressed air blower, and a conduit leading from the outlet side of the blower is preferably disposed to provide the flow to the annular space between the housing and the perforated drum.

In order to subject the interior of the spin-drying drum to a negative pressure, the space between the washing unit of the laundering system and the spin-drying unit is preferably constructed as a substantially closed transfer chamber to which a suction or pipe line, leading to the intake side of a blower, can be connected. A single blower may be utilized to provide the pressurized flow to the annular space about the perforated drum and to provide the suction to the interior of the drum, thus providing a selectively useable continuous flow circuit.

In apparatus in which the washing unit comprises a substantially horizontal washing drum, as is common in straight-through drum type washing machines, it is preferred, in accordance with the present invention, that the spin-drying drum axis extends substantially in the direction of the horizontal washing drum axis. This arrangement is, of course, contrary to the configuration of more commonly known spin-drying drums utilizing a vertical axis. A substantially horizontal spin-drying drum axis presents considerable advantages, however, starting with the loading of the drum. By this arrangement, the spin-drying drum is arranged such that the washing drum can readily discharge batches of laundry from its discharge end so they pass without difficulty into the spin-drying unit. In the system of the present invention, the floor of the transfer chamber may be utilized as a transfer means and is preferably constructed to slope slightly downwardly from the washer unit to the spin-drying unit to enhance the movement of the laundry batch from one unit to the other. Accordingly, the present invention provides that the spin-drying drum axis may be inclined downwardly slightly to the washing drum axis, preferably at an angle of about twenty (20°) degrees, whereby the spin-drying drum is oriented to readily receive the laundry batch from the washing unit.

Still another preferred aspect of the present invention relates to improved drying of the laundry as well as sterilization to render the laundry substantially germ free. Specifically, before and/or during the spin-drying of the laundry from which water has been extracted, means may be utilized to connect the fluid pressure conduit to the suction conduit (which for this purpose is not being utilized to effect a suction therethrough) and the intake side of the blower may be adapted to pick up a hot air flow (which is preferably waste air flow from adjacent dryers or similar equipment of the system which usually provide hot exhaust air at a temperature of about 100° C.).

While it is known in the prior art to achieve a more rapid drying effect by increasing the temperature of the material to be dried, this has commonly been accomplished by directing hot steam to the laundry batch. While water extraction effect may be improved by application of steam flow to the laundry batch to increase the temperature, condensation of the steam as it encounters the rather cooler laundry results in additional water which must be extracted, thereby increasing the time required for the total extraction operation. In comparison, the use of a normally wasted hot air flow from adjacent equipment, as provided by the present invention, provides the desired temperature increase to speed up the extraction process but does not have the disadvantage of introducing the significant amount of additional water associated with a steam flow. The resultant economic advantage associated with this aspect of the present invention is considered obvious.

BRIEF DESCRIPTION OF THE DRAWING

The features and advantages of this invention, including those set forth above and others not specifically herein described, will be apparent from the ensuing detailed description and by reference to the accompanying drawing wherein.

DETAILED DESCRIPTION OF THE PREFERRED EMBODIMENT

Figure 1:
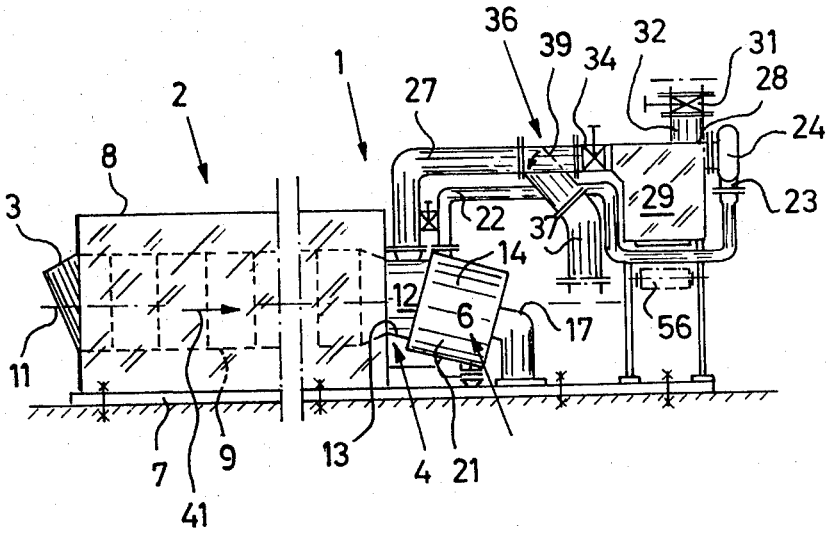
FIG. 1 is a diagrammatic side elevational view of apparatus in accordance with the present invention, in which some details have been omitted for the sake of clarity, and, FIG. 2 is a view similar to FIG. 1 but on a comparatively enlarged scale to better illustrate certain details of the apparatus.
Figure 2:
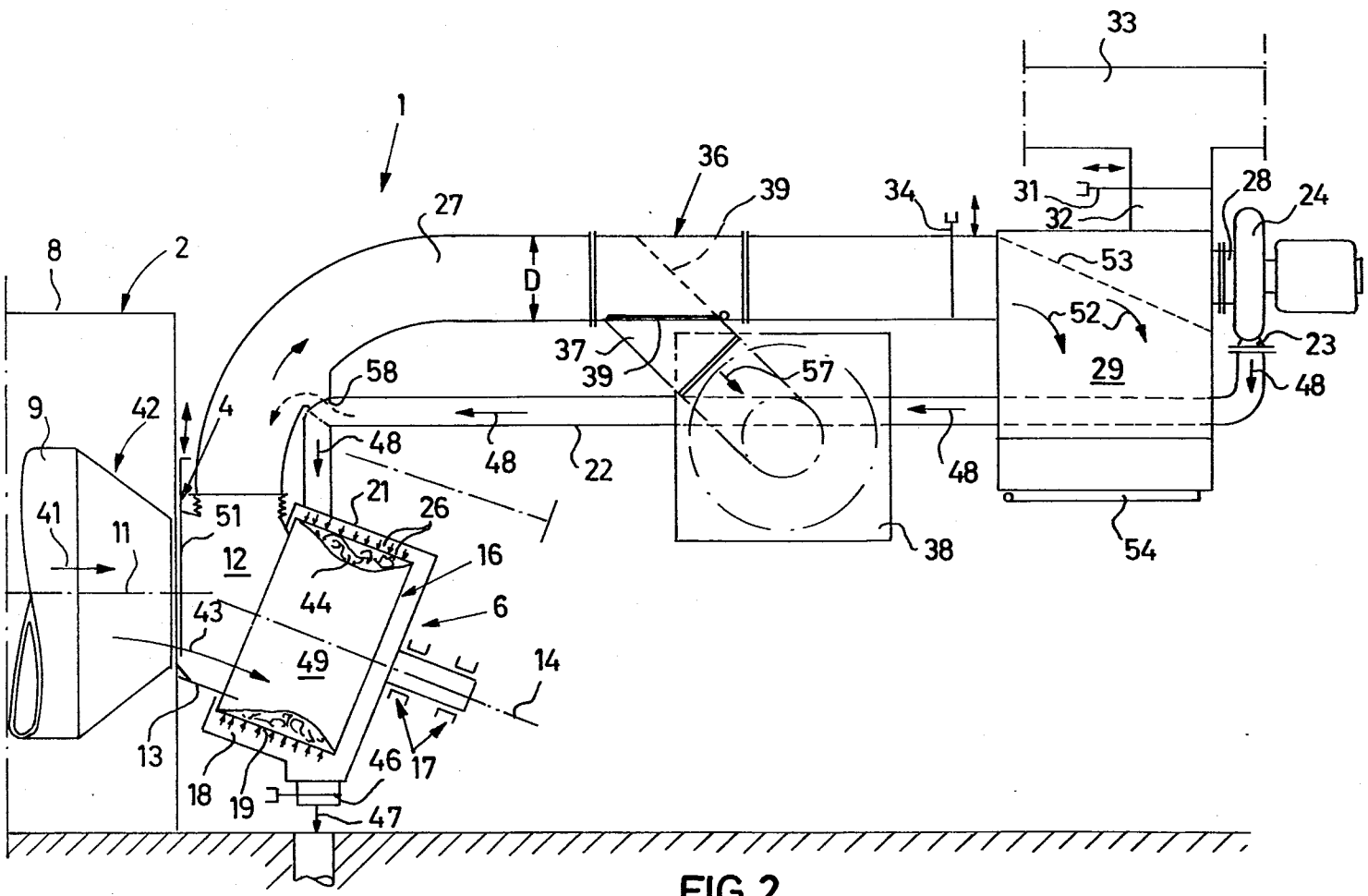

FIGS. 1 and 2 show a system or apparatus 1 for the treatment of laundry. System 1 comprises a washing unit 2 into which laundry is introduced for washing at a charging station through a charging hopper 3, and an output station 4 from where wash laundry is transferred, together with the final rinse water, to a spin-drying unit 6.

The washing unit 2 is a counter-current double-drum straight-through washing machine which includes the charging hopper 3, a housing 8 fixed and supported on a base frame 7, and a washing drum 9 which is made up of a number of individual segments and has an axis 11 extending generally horizontally.

The space between the outlet for the washing unit 2 and the spin-drying unit 6 is constructed as a substantially closed transfer chamber 12, the floor of which is established at an angle of 22° to the washing drum axis 11 to act as a chute-like transfer means between the washing unit 2 and the spin-drying unit 6. The axis 14 of the drum 6 is inclined downwardly at the same angle to the drum axis 11.

As shown in FIG. 2, a stand 17, fixed to the base frame 7, supports the spin-drying unit 6, which includes a rotatable drum 16. A space 18 is defined between a casing 19 of the spin-drying drum 16 and a housing 21 of the spin-drying unit 6. The space 18 is concentric or circumjacent the drum 16 and is in flow communication with a pressure pipe line or conduit 22 leading to the pressure side or outlet 23 of a blower 24 whereby the space 18 can be subjected to a fluid pressure flow in the direction of arrows 26. Leading from the intake or inlet side 28 of the blower 24 is a suction pipe line or conduit 27 connected in flow communication to the transfer chamber 12.

At the end portion remote from the transfer chamber 12 and adjacent the blower 24, the free cross-section of the suction pipe line 27 having a diameter D is considerably outwardly expanded to form a substantially wide separating chamber 29. The separating chamber 29 is provided with a conduit 32 in fluid flow connection therewith which leads to a waste air pipe 33 for carrying hot waste air flow from dryers or wringing machines (not shown) of the system. A valve 31 enables selective closing of the conduit 32.

Immediately upstream of the chamber 29, in the suction conduit 27, a valve 34 is provided to enable selective closing of the conduit 27 when required. Upstream of valve 34 in the conduit 27, a selectively operable routing means 36 is provided which enables the conduit 27 to be placed in flow communication either with the separating chamber 29 or a dryer 38 connected to the underside of the routing means 36 by a branch conduit 37.

As illustrated in FIG. 2, a by-pass flap 58 is provided between those end portions of the pressure conduit 22 and suction conduit 27 which are situated adjacent the spin-drying unit 6. The by-pass flap 58 is pivotal out of the solid line position shown in FIG. 2 wherein it will prevent the compressed air delivered by the blower 24 from being passed into the conduit 27, into a broken line position in which it closes the pressure conduit 22. In the latter condition, the compressed air delivered by the blower 24 does not flow, when the valve 34 is closed, out of the pressure conduit 22 into the space 18 between the drum casing 19 and the spin-dryer housing 21, but flows instead into the suction pipe line 27 (which is not subjected to suction in this condition) in accordance with the broken line arrow and then via the transfer chamber 12 to the interior 49 of the spin drying drum 16. With the valve 31 open, the blower 24 thus draws in hot air at a temperature of about 100° C. from the waste air conduit 33 so that laundry 44, from which water is being extracted, is subjected to warmer hot air to not only abruptly increase the degree of drying but also to kill any bacteria remaining in the laundry.

Operation of the apparatus of the invention is hereafter described as beginning after a batch of laundry has passed through the washing drum 9 of the washing unit 2 in the direction of an arrow 41 (see FIG. 2) and has reached the outlet 4. From the outlet 4 the laundry batch is transferred, together with its final rinse water, in the direction of an arrow 43 to the spin-drying unit 6. The laundry is passed from the washing drum 9 through a conically tapering end portion 42 thereof, by means of a feed screw (not shown) therein, and slides over the floor 13 of the transfer chamber 12 into the spin-drying drum 16, which is adapted to rotate about its axis 14 during the actual transfer operation. Since the laundry is mixed with its rinse water at this transfer stage, there is an extremely good uniform distribution of the laundry 44 and the rinse water is able to flow off through apertures in the perforated spin-drying drum 16 and pass to the space 18 between the drum casing 19 and the housing 21. From there the drained off water can flow in the direction of an arrow 47 via an outlet connection 46.

The actual water extraction operation takes place when the spin-drying drum speed is increased either continuously or abruptly, the water present in the laundry 44 largely being removed by centrifugal force and being able to flow off through the outlet connection 46. During spin-drying the bypass flap 58 is in the broken line position shown in FIG. 2, the valve 34 being closed and the valve 31 open, so that the laundry is subjected to hot air from the blower 24.

After the spin-drying drum 16 has been stopped, the laundry 44, from which the water has been extracted, is in a tangled state, such that it is pressed tightly against the inside of the spin-drying drum 16.

Before the blower 24 is switched on, flap 58 is returned to the solid line position shown in FIG. 2 and the valve 34 is opened. Compressed air then flows from the outlet side 23 of the blower 24 via the pressure conduit 22 in the direction of arrow 48, into the space 18 between the drum casing 19 and the housing 21. The compressed air is uniformly distributed in the space 18 as shown by the arrows 26, and passes from outside through the apertures in the perforated drum casing 19, during which the laundry 44, initially adhering tightly to the inside of the drum 16, is quickly released.

If the valve 34 in the suction conduit 27 is open and the valve 39 in the routing means 36 has been swung down, and if at the same time the valve 31 at the outlet 32 is closed, the blower 24 draws air from the transfer chamber 12 and the interior 49 of the drum 16 via the intake 28 and the suction conduit 27. The outlet 4 from the washing unit 2 can be closed by valve 51 or the like but this is not absolutely necessary.

The negative pressure formed in the interior 49 of the spin-drying drum 16 acts on the laundry 44 along with the compressed air acting on the laundry 44, in the direction of the arrows 26, to release the laundry 44 from the inside of the drum 16. An additional affect of the negative pressure thus established is that the laundry 44 is also considerably loosened, the unexpected affect being that separation of the individual items in the batch of laundry is quite extensive or even substantially complete.

The separate individual items then pass from the interior 49 in the spin-drying drum 16, via the transfer chamber 12 and in the suction conduit 27, into the separating chamber 29 which is formed by an expanded portion of the suction conduit 27. The deceleration of the air flow in the chamber 29 causes the laundry to be deflected downwardly in the direction of the arrows 52. A screen 53 also acts to insure that the items of laundry will cascade downwardly. This screen 53 is disposed to slope at an angle in the chamber 29 in the direction of movement of the laundry items and serves to prevent the laundry items from reaching the inlet side 28 of the blower 24 or the waste air outlet 32. At this point, laundry for wringing can be moved from the chamber 29 by the opening of a bottom flap 54 and, if necessary, can be fed to a wringer by means of a conveyor belt 56 (FIG. 1) or the like. If the laundry is not to be wrung out, but is to be completely dried, the flap 39 in the routing means 36 is swung up into the broken line position shown in FIG. 2, so that the items of laundry now pass not to the chamber 29 but to a dryer 38 through the branch conduit 37.

It has been found that if the suction conduit 27 is made from plastic, such as a polyvinyl chloride composition, with a smooth surface and a diameter of about 400 mm, and if excessively sharp curves in the conduit 27 are avoided, the laundry, which is initially tightly compressed after extraction of the water, can be rapidly transported without difficulty and, after extraction of the water, is not only quickly and effectively released but also so considerably loosened and separated that there is no need for a separate tumbling operation. Since the washed laundry from the washing unit 2 can also be distributed very uniformly in the spin-drying drum together with the rinse water, there is a very uniform extraction of the water from the laundry so that it can be further treated without difficulty and can be quite expeditiously brought to its final dry state by subsequent treatment in a dryer.

Since the apparatus of the present invention dispenses with numerous intermediate conveyors commonly used in present day laundry systems, the investment otherwise required for such equipment is avoided and the transport of laundry from one treatment station to the next does notinvolve the familiar problems of items in the laundry spilling over or hanging up during conveying between stations. It should, therefore, be now apparent that the apparatus and method for treatment of laundry, as heretofore described, will provide a comparatively more reliable, rapid, and economical laundry system that ensures careful and safe handling of laundry under treatment.

The structure described herein and shown in the accompanying drawing was selected for the purpose of illustrating the invention and is not intended to limit the scope of the invention. It is contemplated that the apparatus of the invention, and the method for its use may be variously adapted, changed or modified without departing from the spirit and scope of the invention as defined in the appended claims.

I claim:

1. An apparatus for treating laundry which utilizes a spin drying perforated drum disposed within a surrounding housing and wherein a circumjacent space is defined between the drum and the housing, the provision therewith of a fluid pressure source connected in flow communication with the circumjacent space to direct a pressurized fluid flow into the space and thence inwardly through the drum perforations, means for selectively curtailing the flow from the pressurized source, means for subjecting the interior of the drum to suction, the fluid pressure source being a compressed air source which is blower interconnected to the housing by an inlet conduit, an open end on the drum connected in communication with the outlet end of a laundry washing unit by means of a laundry transfer chamber, suction means for creating negative pressure within the drum, and the suctions means including an outlet conduit from the transfer chamber which leads to the intake side of a blower.

2. The invention of claim 1 further including an inlet conduit directing the fluid pressure source to the circumjacent space and wherein the inlet conduit and the outlet conduit are connected to a single blower.

3. The invention of claim 1 wherein the outlet conduit includes a widened intermediate portion at a point along the length thereof remote from the transfer chamber which serves as a laundry separating chamber.

4. The invention of claim 3 wherein the separating chamber has a selectively closable waste air outlet.

5. The invention of claim 3, wherein the outlet conduit is provided with a valve located between the separating chamber and the transfer chamber, a branch conduit communicates from a port in the sidewall of the outlet conduit to a branch conduit, and the port is located between the valve and the transfer chamber, an optionally operable routing means is provided within the outlet conduit and adjacent the port, and the branch conduit is adapted for connection to a drying unit.

6. The invention of claim 3 wherein the separating chamber has, on the bottom thereof, a closable outlet aperture for the removal of laundry from which liquid has been extracted.

7. The invention of claim 1 further including a washing unit having a washing drum with a substantially horizontal axis and wherein the axis of the spin-drying drum extends substantially in the direction of the washing drum axis.

8. The invention of claim 7 wherein the spin-drying drum axis is inclined downwardly at an angle of about 15° to 30° to the washing drum axis.

9. The invention of claim 7, wherein the spin-drying drum axis is inclined downwardly at angle of inclination of about 20° to the washing drum axis.

* * * * *